United States Patent [19]

Grimwood et al.

[11] 4,443,213

[45] Apr. 17, 1984

[54] DECANTING TYPE CENTRIFUGE

[75] Inventors: Geoffrey L. Grimwood, Holmfirth, Nr. Huddersfield; John Wright, Huddersfield, both of England

[73] Assignee: Thomas Broadbent & Sons Limited, Huddersfield, England

[21] Appl. No.: 513,044

[22] Filed: Jul. 12, 1983

[30] Foreign Application Priority Data

Jul. 13, 1982 [GB] United Kingdom ..... 8220297

[51] Int. Cl.[3] ..... B04B 1/20

[52] U.S. Cl. ..... 494/38; 494/53; 494/900

[58] Field of Search ..... 494/38, 40, 52, 53, 494/61, 900; 55/202, 203, 206, 207, 409

[56] References Cited

U.S. PATENT DOCUMENTS 3,273,789 9/1966 Koffinke ..... 494/39

4,240,578 12/1980 Jackson ..... 494/53

4,313,559 2/1982 Ostkamp et al. ..... 494/53

4,378,906 4/1983 Epper et al. ..... 494/53

*Primary Examiner*—Robert W. Jenkins

*Assistant Examiner*—Arthur D. Dahlberg

*Attorney, Agent, or Firm*—Pravel, Gambrell, Hewitt, Kirk & Kimball

[57] ABSTRACT

A decanting type centrifuge having a main bowl which is adapted to be rotated about its longitudinal axis and which contains a helical scroll conveyor which is arranged to rotate about the main bowl axis at a slightly different speed to the main bowl for scrolling separated solids to a solids discharge end of the bowl. The centrifuge includes a means which acts to isolate a gas volume radially inwardly of the inner liquid surface within the bowl and also a passage arrangement which enables gas to be extracted continuously from the isolated gas volume to a location external to the main bowl.

13 Claims, 20 Drawing Figures

DECANTING TYPE CENTRIFUGE

DESCRIPTION

The present invention relates to centrifuges of the decanting type.

Decanting type centrifuges employ a main bowl which is adapted to be rotated about a horizontal or vertical axis and which contains a helical scroll conveyor which is arranged to rotate at a slightly different speed to the main bowl for scrolling separated solids to a solids discharge end of the bowl. The separated liquid phase(s) is normally discharged at the opposite end of the bowl. The bowl itself can be of two principle types, namely the solid bowl type and screen bowl type. In the latter type, the solids are caused to move over a perforated screen portion of the bowl prior to their discharge from the bowl.

Existing decanter centrifuges of both the solid and screen bowl types can function (a) to separate solid particles from a liquid where the solids have a larger specific gravity than the liquid, this being referred to as two-phase separation, (b) to separate into three fractions solid particles in a mixture of two liquids where the solids have a larger specific gravity than both liquids and the liquids (one of which is immiscible) have differing specific gravities, this being referred to as three-phase separation or (c) to classify solids, that is to split the solids so that particles above a selected size are discharged as solids and particles below that size are discharged with the liquid or liquids. In the description which follows, the term "separate", when applied to solids and liquids, includes also the classification function.

An object of the present invention is to modify the design of both solid and screen bowl decanters so that, in addition to separating the slurries of solids and liquid(s) as described above, such centrifuges can also separate gas or vapor fed to them with the slurry, including gas insulation in the liquid.

The term "gas" as used hereinafter includes vapors.

In accordance with the present invention there is provided a means for isolating a gas volume radially inwardly of the inner liquid surface within the bowl and passage means enabling gas to be extracted continuously from said gas volume to a location external to the main bowl.

In the simplest case, the gas isolating means can ocmprise a pair of annular plates carried by the conveyor hub for rotation therewith, the diameter of these plates being less than the inner surface of the scroll solids and greater than the inner free surface of the liquid in the bowl. When gas uncontaminated by air is required the input slurry is fed to the bowl interior via radially outwardly extended feed ports open beneath the liquid surface within the bowl.

The annular disc at the liquid outlet end of the bowl can be obviated by the provision of floating weir plates which float on the liquid surface leaving the bowl through holes in the bowl end plate whereby to seal that end of the bowl against the egress of gas.

In an alternative structure, the annular plate at the liquid outlet end of the bowl can be attached to the bowl trunnion instead of the conveyor if the liquid leaving that end of the bowl is first collected in a cylindrical chamber into which the latter annular plate is arranged to extend so that its periphery lies beneath the liquid surface therein.

Alternatively, the latter annular plate can be fixed so as to be stationary relative to the bowl and to the conveyor.

The invention can be applied to both counter-current and con-current flow centrifuges. In the latter instance, in the simplest case, the gas isolation means can comprise a single annular plate carried by the frusto-conical part of the conveyor hub, the gas volume being defined between the latter plate, the frusto-conical surface of the hub and the inner cylindrical surface of the liquid in the bowl.

The invention is described further hereinafter, by way of example only, with reference to the accompanying drawings, in which.

Figure 1:
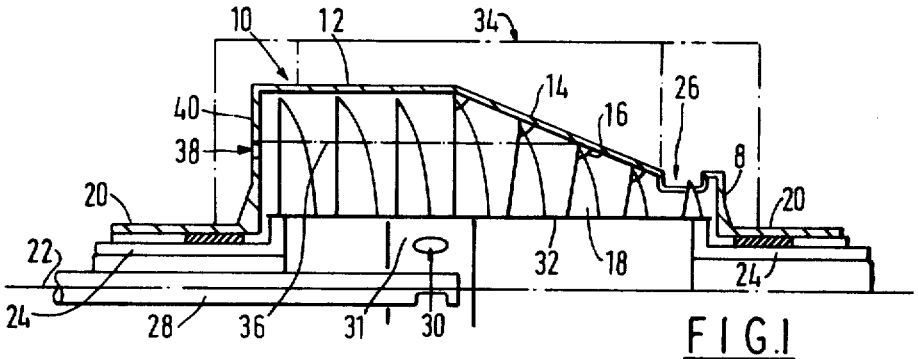
FIG. 1 is a partial longitudinal section of a conventional solid bowl decanter centrifuge.

FIG. 1 shows a conventional solid bowl decanter centrifuge for two-phase solids/liquid separation duties comprising a solid bowl 10 having a cylindrical portion 12 and a frusto-conical portion 14 which provides a ramp up which separated solids 16 can be scrolled by means of a helical screw conveyor 18. The bowl 10 is mounted by way of a trunnion 20 and is rotated about a central longitudinal axis 22 by a drive means (not shown). The conveyor 18 is carried by way of a trunnion 24 mounted within the bowl trunnion 20 and is arranged to be rotated at a slightly different speed to the bowl for scrolling the separated solids to a solids discharge end of the bowl (right-hand end as viewed in FIG. 1) where the solids are discharged via an outlet 26. Slurry is introduced into the bowl interior via a feed pipe 28 and feed ports 30 in a feed zone 31 of the conveyor hub 32. The bowl is surrounded by a casing 34.

In use, the slurry entering the bowl 10 is subjected to centrifugal forces as a result of the rotation of the bowl and the slurry separates into a solids phase and liquid phase. The surface of the liquid is indicated at 36, this level being determined by the radial position of a liquid outlet port(s) 38 in the end plate 40 of the bowl 10.

Figure 2:
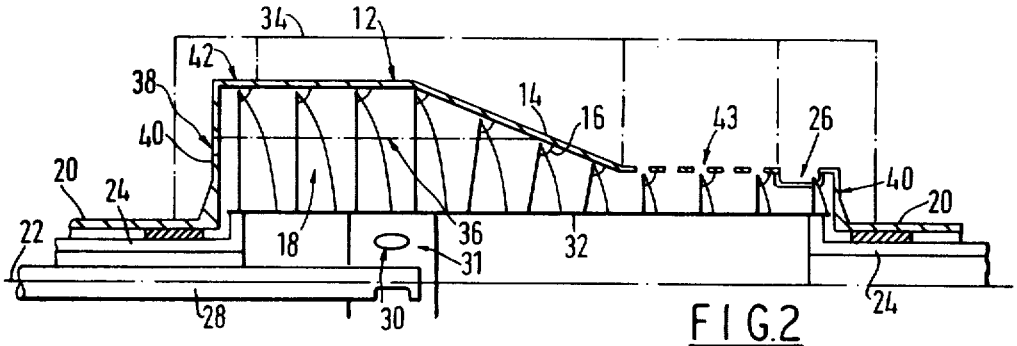
FIG. 2 is a partial longitudinal section of a conventional screen bowl decanter centrifuge.

FIG. 2 shows a conventional screen bowl decanter centrifuge for two-phase solid/liquid separation. The structure of this centrifuge is identical to that of the solid bowl centrifuge of FIG. 1 except that the bowl 42 includes a cylindrical screen portion 43 through which liquid and fine solids can pass to achieve additional drying and separation which may be required in certain circumstances. Those parts of the centrifuge which are identical to the centrifuge of FIG. 1 are given the same reference numbers.

Figure 3:
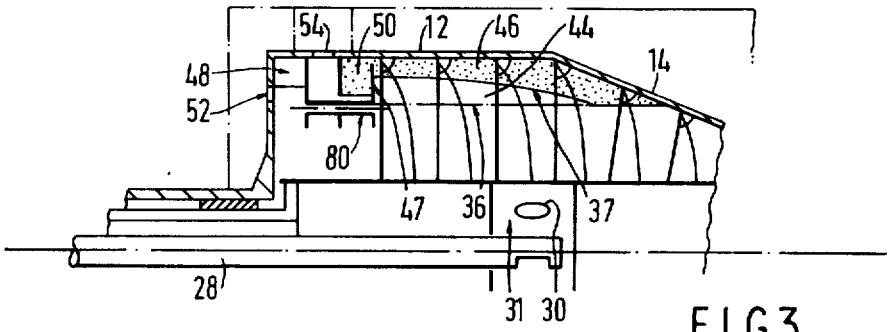
FIG. 3 is a partial longitudinal section of a conventional decanter centrifuge for solids/liquid/liquid separation.

FIG. 3 shows the changes necessary to the liquid discharge end of either of the centrifuge of FIG. 1 and FIG. 2 when three-phase separation of solids and two liquids is required. Again, reference numerals corresponding to those of FIGS. 1 and 2 are used where appropriate. When two liquids are present, these are also separated as a result of the high centrifugal forces to which they are subjected. The liquid 44 of lower specific gravity, referred to as the light phase, moves towards the inner liquid surface 36 within the bowl, with the liquid 46 of higher specific gravity, referred to as the heavy phase, moving towards the surface of the bowl interior. The interface between the two liquid phase is marked 37. By means of a suitably disposed dividing plate 47, the light and heavy phases 44, 46 are discharged into separate compartments 48, 50, respectively from where they are removed via respective outlets 52, 54.

The arrangements as described thus far are well known.

In the arrangements in accordance with the invention which are described hereinafter, by isolating in a gas-tight manner a substantial volume of the decanter which contains the feed zone 31, any free gas fed with the slurry to the centrifuge via the feed pipe 28 will, by virtue of its low specific gravity, be displaced by the 'G' forces on the other heavier constituents of the slurry and will flow inwards towards the axis of the centrifuge into the isolated volume for separate collection via sealed passages.

In these arrangements, the liquid around the isolated volume is subjected to the high 'G' forces of rotation and hence to the high hydraulic pressures whilst its inner free surface 36 remains at or near atmospheric pressure. Under these conditions, gas dissolved in the liquid will be freed out of solution, will form bubbles of low-specific gravity and will move rapidly through the inner free surface 36 to collect in the isolated gas volume.

A number of embodiments in accordance with the present invention are now described illustrating different ways in which the mechanical design of decanting centrifuges can be changed so as to isolate a volume in which the gas separation and collection can occur, without interfering in the primary solid/liquid(s) separation function.

FIGS. 4 to 7 are concerned with solid and screen bowl decanter centrifuges of the type which separate two phases which are now to separate solid, liquid and gas phases.

Figure 4:
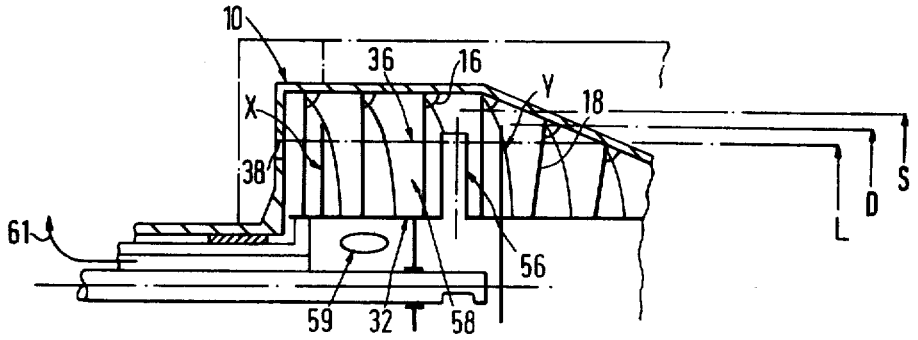
FIG. 4 is a partial longitudinal section of a first embodiment in accordance with the present invention for solid/liquid/gas separation.

FIG. 4 shows the simplest arrangement in which two flat annular discs X and Y are fixed to and rotate with the conveyor hub 32, each disc being of an outside diameter D greater than the diameter L of the inner free surface 36 of the liquid and less than the diameter S of the inner surface of the scrolled solids 16. The two discs X and Y with outside diameters submerged under the liquid surface 36, together with the conveyor hub 32 and feed port extensions 56, contain the isolated volume 58 in which gas/liquid separation takes place at the inner liquid surface whilst liquid/solids separation takes place near the liquid periphery. The slurry is introduced via radially extended feed ports 56. Gas thus separated flows through a gas port(s) 59 and along the path 61 shown. The latter flow can be induced if necessary by externally applied suction to collect only the gas and/or vapour fed with the slurry plus any gas released from solution in the liquid.

If the collected gas and/or vapour is acceptable contaminated with air, then a simpler construction may be adopted by omitting the slurry feed port extensions 56, allowing the externally applied suction to draw air through the unextended slurry feed ports (which normally do not flow completely full of slurry).

Figure 5:
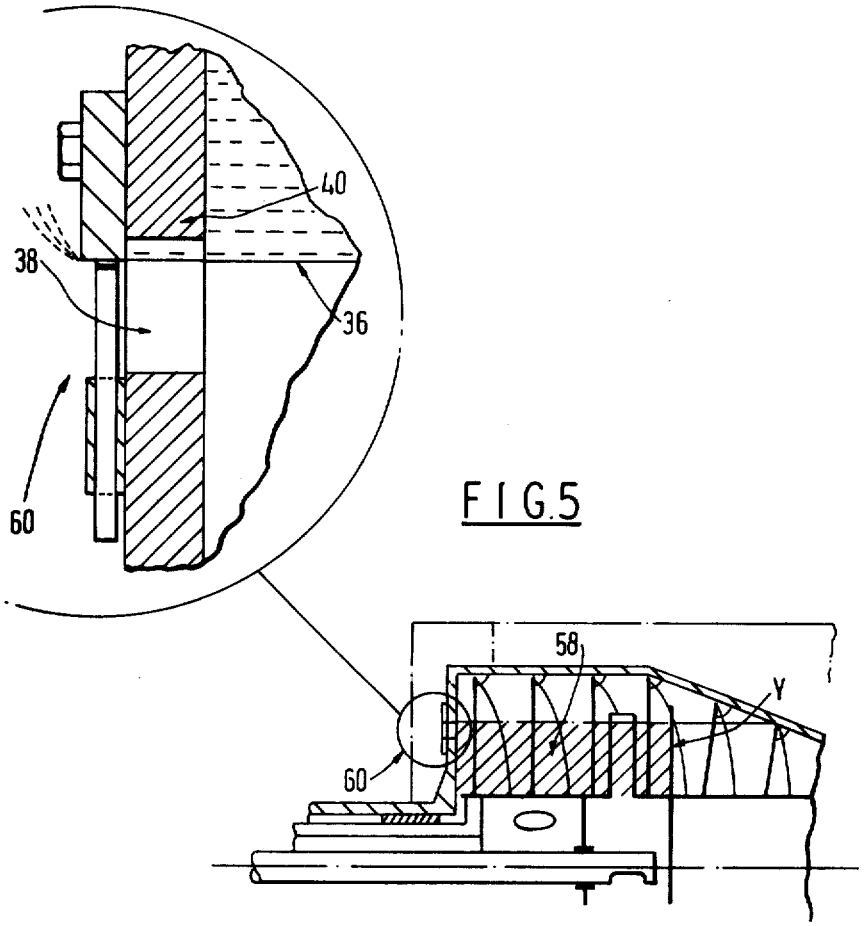
FIG. 5 is a partial longitudinal section of a second embodiment in accordance with the present invention utilising floating weir plates.

FIG. 5 shows an alternative construction in which, in order to increase the isolated volume for gas separation, the annular ring X is replaced by floating weir plates 60 to cover the unsubmerged area of each liquid outlet 38 in the bowl. Each plate 60 is made of light or hollow material and is mounted in guides so as to float on the liquid surface, allowing just sufficient opening for liquid discharge and thus sealing the bowl liquid end plate 40 against the outflow of gas or vapour so that the sealed bowl end plate 40 forms part of the gas isolation volume 58.

Figure 6:
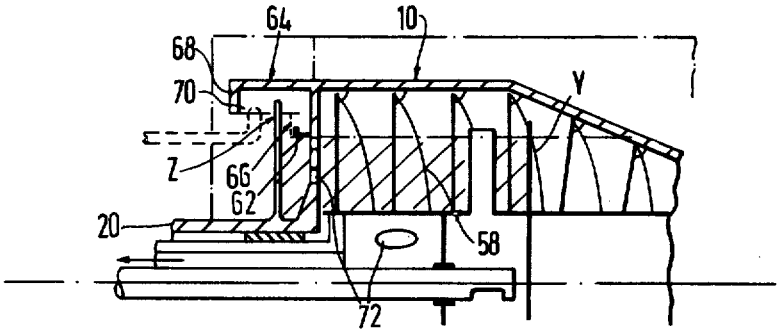
FIG. 6 is a partial longitudinal section of a third embodiment in accordance with the present invention for gas separation enhanced by spilling liquid over a lip.

Allowing the separated liquid to flow over a lip 62 and into a cylindrical chamber 64 formed by an extension of the bowl 10 and containing an annular disc Z fixed to and rotating with the bowl trunnion 20 (all in place of the disc X), as shown in FIG. 6, increases the isolated volume and capacity to separate gas. It offers the added advantage of causing the liquid to flow radially outwards in a thin film 66, increasing the surface area per unit volume and separation of gas in solution and giving an effective design for maximum gas separation. The separated liquid either spills over the weir 68 or is skimmed from the surface of the cylindrical chamber by a skimmer pipe, paring disc or other known means 70. Gas ports 72 are provided in the conveyor hub and the end wall of the bowl.

Figure 7:
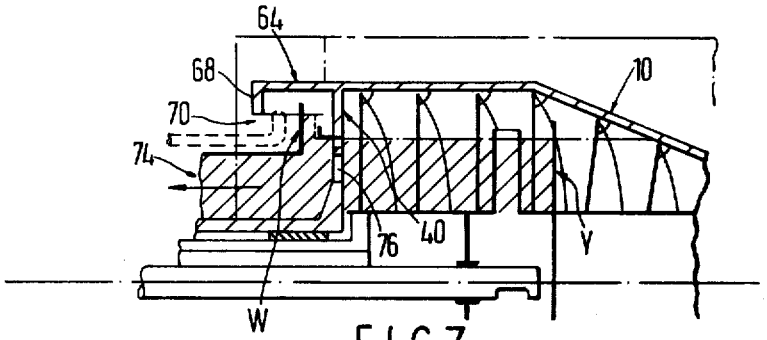
FIG. 7 is a partial longitudinal section of a fourth embodiment in accordance with the present invention for gas separation with enhanced area for flow of large volume of separated gas.

An alternative construction, shown in FIG. 7, uses the same bowl construction as that shown in FIG. 6 with the separated liquid flowing into the cylindrical chamber 64. A stationary annular disc W, of diameter D larger than the inner free surface of the liquid in the cylindrical chamber 64, is attached to and supported by the gas outlet 74. The bowl end plate 40 has gas ports 76 permitting the separated gas to flow in the direction shown. Such a design may be used primarily to provide maximum gas outlet area when large gas volumes are to be separated.

FIGS. 8 to 14 are concerned with solid and screen bowl decanter centrifuges of the type which separate three phases and which are now to separate solid/-liquid/liquid/gas phases.

Figure 8:
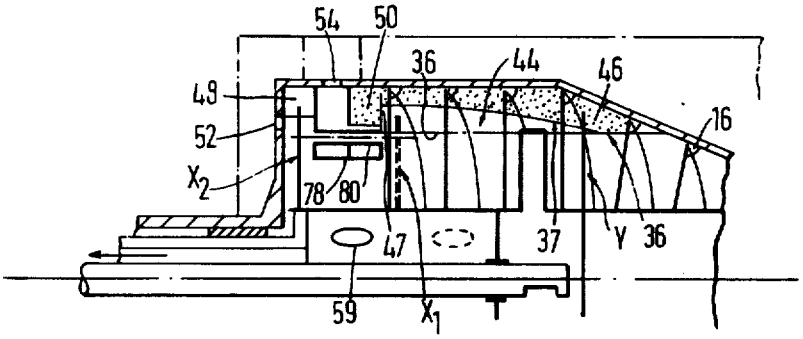
FIG. 8 is a partial longitudinal section of a fifth embodiment in accordance with the invention for separating solids, two liquids and gas.

The simplest arrangement using rotating annular discs X and Y is applicable to this type of decanter also, as shown in FIG. 8, wherein the diameter D of the discs is greater than the diameter of the inner free surface 36 of the liquid with the lowest specific gravity. One annular disc may be positioned at $X_1$ or, for increased gas separation volume, at $X_2$. In the latter case, a cylindrical sealing plate 78 is fitted to isolate the gas volume from the ingress of air through the heavy phase liquid outlet 54 if gas uncontaminated with air is required. Pipes 80 connect separated light phase liquid to the light phase compartment 48.

Figure 9:
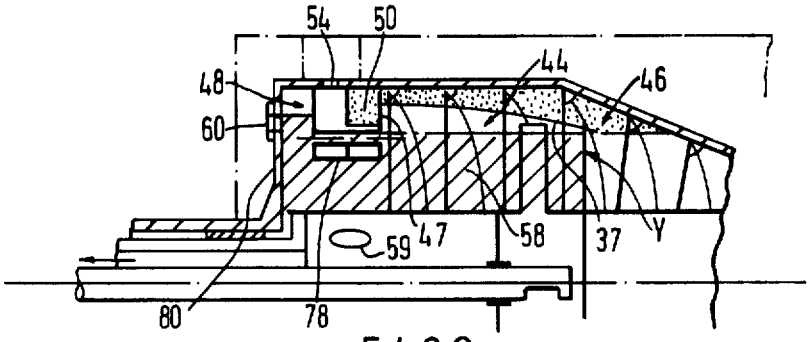
FIG. 9 is a partial longitudinal section of a sixth embodiment in accordance with the invention similar to the fifth embodiment but using floating weir plates.

An alternative construction is shown in FIG. 9 wherein the annular discs $X_1$ and $X_2$ are replaced by floating weir plates 60, as in FIG. 5, to cover the unsubmerged area of each outlet port of the light phase liquid. Again a cylindrical plate 78 is fitted to isolate the gas volume from the ingress of air through the heavy phase liquid outlet 54.

Figure 10:
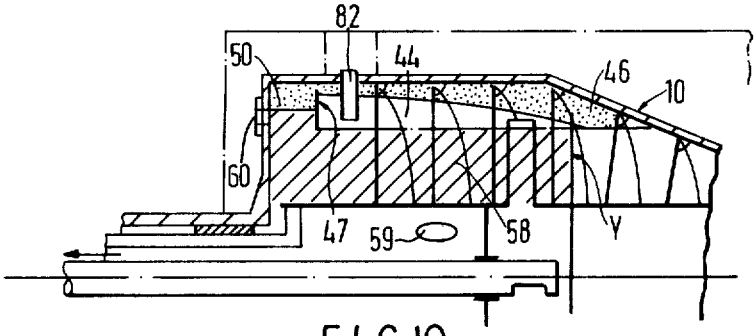
FIG. 10 is a partial longitudinal section of a seventh embodiment in accordance with the present invention using floating weir plates and designed for solids/-liquid/liquid/gas separation.

A further alternative construction is shown in FIG. 10. In this arrangement, the separated light phase liquid 44 flows from the bowl through radial outlet pipes 82 in the bowl wall. The separated heavy phase liquid 46 passes under the dividing plate 47 to the liquid compartment 50 and flows out of the outlet ports over the floating weir plates 60, which cover the unsubmerged portion of the outlet ports and thus seal the isolated gas volume.

By providing an additional cylindrical chamber 64, improved constructions are made for situations where solids/liquid/liquid/gas separation is required—equivalent to that shown in FIGS. 6 and 7 for the solids/-liquid/gas phase separations. The arrangements shown in FIGS. 11, 12, 13 and 14 shows these improvements, equivalent parts from previous embodiments again being designated by the same reference numerals.

Figure 11:
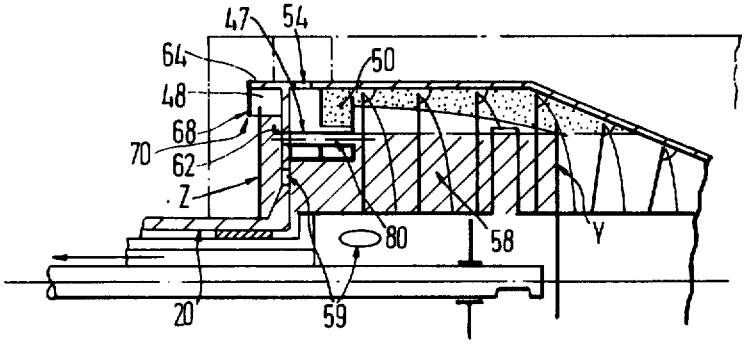
FIG. 11 is a partial longitudinal section of an eighth embodiment in accordance with the invention having an increased gas separation volume.
Figure 12:
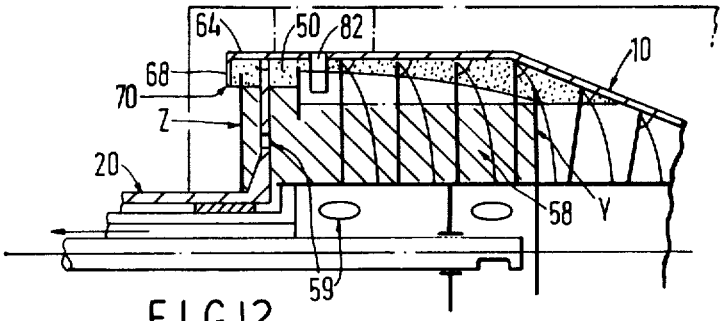
FIG. 12 is a partial longitudinal section of a ninth embodiment in accordance with the invention for solids/liquid/liquid/gas separation.
Figure 13:
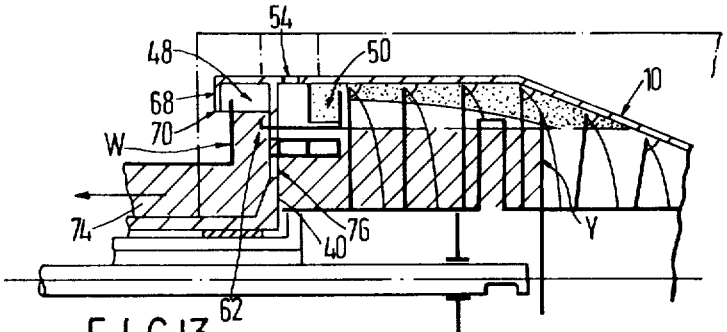
FIG. 13 is a partial longitudinal section of a tenth embodiment in accordance with the invention having an enhanced area for flow of large volumes of separated gases.
Figure 14:
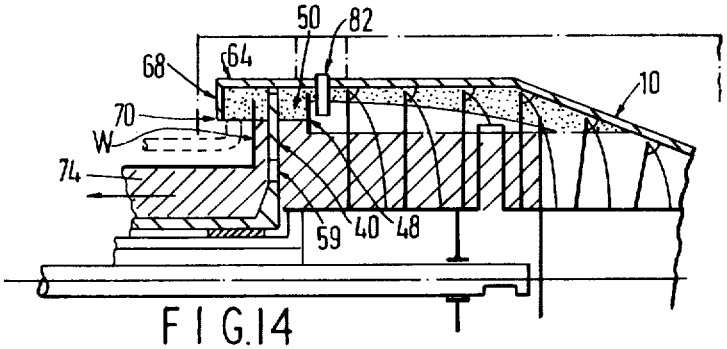
FIG. 14 is a partial longitudinal section of an eleventh embodiment in accordance with the invention again having an enhanced area for flow of large volumes of separated gases.

FIGS. 11 and 12 shows a gas separation volume sealed by discs Y and Z and FIGS. 13 and 14 shows a gas separation volume sealed by discs Y and W. The outside diameters of discs Z and W are greater than the diameter of the inner free surface of the liquid in the cylindrical compartments 64 and disc Y is as described previously. In FIGS. 11 and 12 the annular disc Z is fixed to and rotates with the bowl trunnion 20, with the separated gas flowing through the gas ports 59 in the conveyor hub 32 and in the bowl end plate 40.

In FIGS. 13 and 14, the annular disc W is stationary and attached to the gas outlet 74 with the separated gas flowing through the ports 76 in the bowl end plate 40 only. In other respects, the arrangements shown in FIGS. 11 to 14 are the same as those already described.

Figure 15:
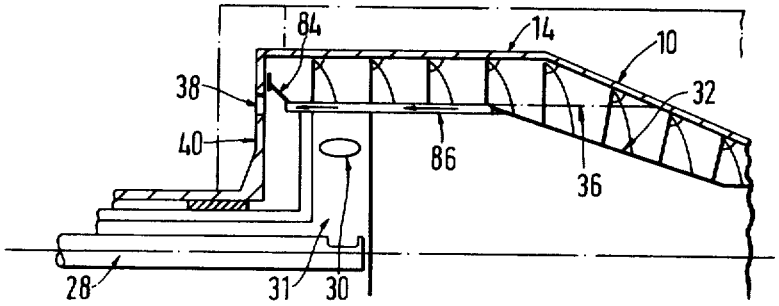
FIG. 15 is a partial longitudinal section of a known decanter centrifuge employing con-current flow.

All of the decanting centrifuges described so far and shown in FIGS. 1 to 14 are of the counter-current type, that is, during the separation process the solids and liquid(s) flow in opposite axial directions. By placing the feed zone 31 near to the liquid discharge end of the bowl and by providing return channels 86 for the separated liquid, the solids and liquid flow can be arranged to occur in the same axial direction during the separation process. A typical known con-current flow decanter of this type is shown in FIG. 15. Normally, concurrent flow decanters perform a two-phase separation only. The present invention enables this to be extended to solids/liquid/gas separation.

Figure 16:
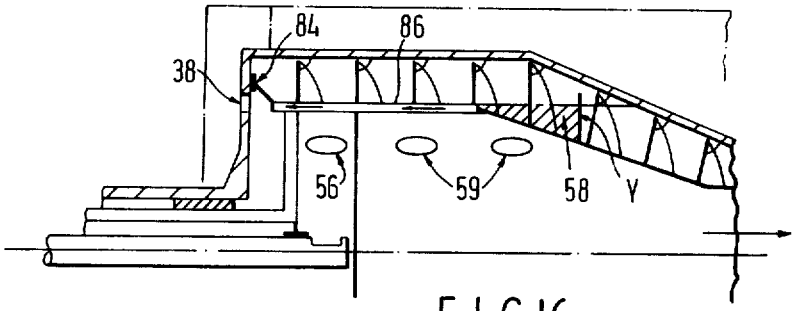
FIG. 16 is a partial longitudinal section of a twelfth embodiment in accordance with the invention employing con-current flow.

Again, the simplest arrangement shown in FIG. 16 uses one annular disc Y of diameter D greater than the diameter of the inner free surface of the liquid and less than the diameter of the inner surface of the scrolled solids. This disc, together with the conveyor hub 32, extended feed ports 56 and a sealing plate 84 provide an isolated gas volume 58 (albeit relatively small) for gas separation with the separated gas flowing through the gas ports 59 and from the decanter hub as shown. This is analogous to the arrangement shown in FIG. 4 except that the feed zone is no longer contained within the isolated gas volume. An alternative arrangement, shown in FIG. 17 to increase the isolated volume for gas separation, allows the separated liquid to flow over a lip 62 into a cylindrical chamber 64 formed by an extension to the bowl and containing annular disc Z fixed to and rotating with the bowl trunnion 20. The lip 62, cylindrical chamber 64 and disc Z operate as described above in connection with FIG. 6. Pipes 88 are fitted through the feed zone 31 to enable the gas separated during liquid flow to discharge to the gas outlet with the gas separated in the solids/liquid separating zone.

Figure 17:
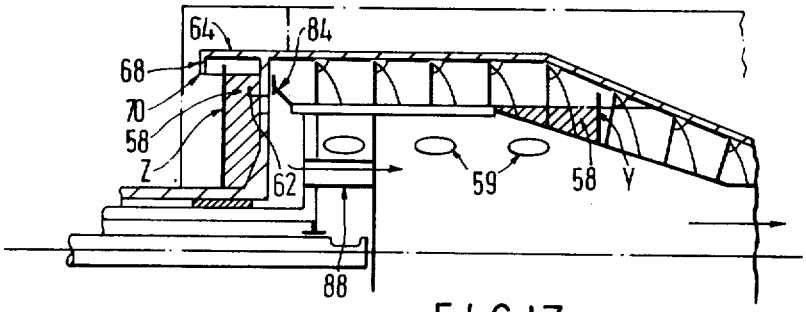
FIG. 17 is a partial longitudinal section of a thirteenth embodiment in accordance with the invention using con-current flow and having an enhanced gas separation volume.
Figure 18:
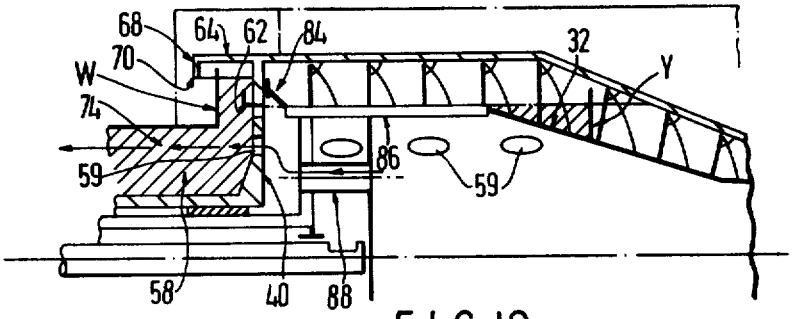
FIG. 18 is a partial longitudinal section of a fourteenth embodiment in accordance with the invention.

A further and preferred alternative is shown in FIG. 18 and uses the same bowl construction as that shown in FIG. 17 with the separated liquid flowing into a cylindrical chamber 64. A stationary annular disc W is attached at and supported by the gas outlet 74. The gas separated in the solid/liquid separating zone flows as shown through pipes 88 fitted through the feed zone and holes 59 in the bowl end plate to discharge with the gas separated during liquid flow over the lip 62.

Figure 19:
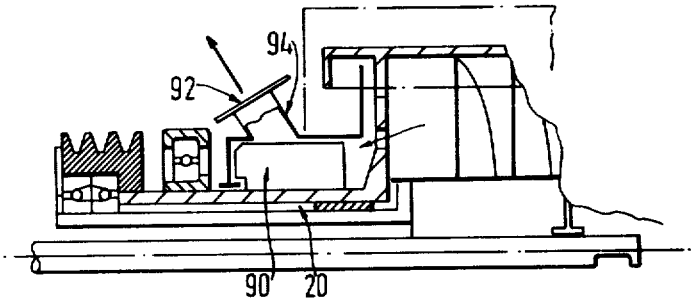
FIGS. 19 and 20 show gas outlet/impeller assemblies for inducing gas flow from centrifuges.
Figure 20:
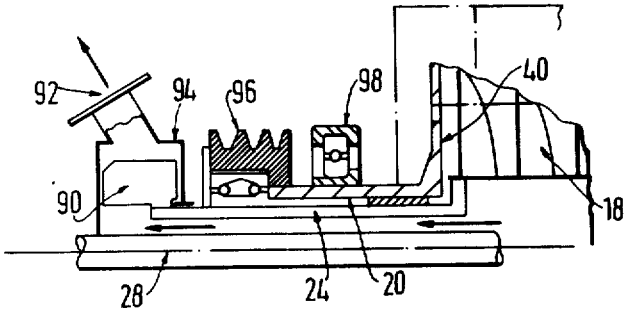

To provide a gas pressure in the isolated gas volume slightly below that of the surrounding atmosphere for the purpose of inducing gas flow and avoiding extraneous gas leakage, a suction can be applied externally. Alternatively, impeller blades 90 within a stationary gas collecting chamber 94, fitted to the bowl trunnion 20 and rotating with it, will induce the required pressure reduction in the isolated gas volume 58. Impeller arrangements suitable for the various decanting centrifuge arrangements are shown in FIGS. 19 and 20. Main pedestal bearings for the bowl trunnion are indicated at 98 and the drive pulley for the bowl trunnion is indicated at 94.

This invention is considered to be particularly advantageous in decanter applications where gas, other than air, is involved. Typically, chemical processes carried out under a gas "blanket" that require removal of the solids and/or liquid(s) from the blanket at the separation stage would use this type of centrifuge. Another application is that of processing oil and gas well drilling mud which requires classifying (i.e. the separation of drilled solids from the mud and fine additives) whilst simultaneously removing any gas that has contaminated the mud either during drilling or during its passage through the drilled hole.

We claim:

1. In a decanting type centrifuge having a main bowl which is adapted to be rotated about its longitudinal axis and which contains a helical scroll conveyor which is arranged to rotate about said main bowl axis at a slightly different speed to the main bowl for scrolling separated solids to a solids discharge end of the bowl, the improvement comprising means which act to isolate a gas volume radially inwardly of the inner liquid surface within said main bowl and passage means enabling gas to be extracted continuously from said gas volume to a location external to said main bowl.

2. A decanting centrifuge according to claim 1, in which said helical scroll conveyor is carried by a cylindrical conveyor hub and in which said means which act to isolate said gas volume comprise a pair of disc means rigidly attached to said conveyor hub for coaxial rotation with said conveyor within the main bowl for defining longitudinal ends of said isolated gas volume.

3. A decanting type centrifuge according to claim 2, including a liquids discharge outlet in the end of the main bowl opposite to said solids discharge end and wherein the periphery of that one of said disc means nearest to the liquids discharge end of the bowl lies radially outwardly of the outermost radial extent of said liquids discharge outlet whereby the outer periphery of that disc is submerged beneath the liquid surface within said main bowl.

4. A decanting type centrifuge according to claim 3, including aperture means in said conveyor hub and means defining a gas outlet passage disposed coaxially of said main bowl, said aperture means leading gas from said gas volume to said gas outlet passage.

5. A decanting type centrifuge according to claim 1, wherein the end of said main bowl opposite to said solids discharge end contains a liquids discharge outlet and the helical scroll conveyor is carried by a cylindrical conveyor hub, and wherein said means which act to isolate said gas volume comprise a first disc means on the conveyor hub disposed adjacent to the solids discharge end of said bowl to define one longitudinal end of said isolated gas volume and a floating weir plate means at said liquids discharge outlet which covers the unsubmerged area of the liquid discharge aperture, whereby said end of the bowl containing the liquids discharge outlet defines the other longitudinal end of said gas volume.

6. A decanting centrifuge according to claim 1, wherein the end of the bowl opposite to said solids discharge end contains a liquids discharge outlet and in which said helical scroll conveyor is carried by a cylindrical conveyor hub, and wherein said means which act to isolate said gas volume comprises a first disc means mounted on said conveyor hub for coaxial rotation therewith and disposed adjacent to the solids discharge end of the bowl to define one longitudinal end of said gas volume and a second disc carried by said hub for coaxial rotation therewith and disposed externally of the liquids discharge end of the bowl such that its outer periphery lies radially outwardly of the radially innermost lip at a liquids chamber carried by the main bowl to receive liquids flowing out of said liquids discharge outlet.

7. A decanting type centrifuge according to claim 1, in which the end of the main bowl opposite to said solids discharge end contains a liquid discharge outlet and in which the helical scroll conveyor is carried by a cylindrical conveyor hub, wherein said means which act to isolate said gas volume comprise a first disc means mounted on the conveyor hub for coaxial rotation therewith and disposed adjacent to the solids discharge end of the bowl to define one longitudinal end of said gas volume and a second, annular disc means which is stationary relative to the bowl and to the conveyor and whose outer periphery lies radially outwardly of the radially innermost lip of a liquids chamber carried by the main bowl to receive liquids flowing out of said liquids discharge outlet.

8. A decanting type centrifuge according to claim 1, adapted for concurrent flow of the solids and liquids within the bowl during the separation process and in which the helical scroll conveyor is carried by a conveyor hub having a cylindrical portion and a frusto-conical portion, and wherein said means which act to isolate said gas volume includes a disc means carried by said frusto-conical portion for coaxial rotation therewith and which defines one longitudinal end of said isolated gas volume.

9. A decanting type centrifuge according to claim 8, including a liquids discharge outlet at the end of the bowl opposite to said solids discharge end and a second disc means disposed externally of the bowl and mounted for coaxial rotation with the bowl, the outer periphery of the second disc means lying radially outwardly of the radially innermost lip of a liquids chamber carried by the main bowl to receive liquids flowing out of said liquids discharge outlet.

10. A decanting type centrifuge according to claim 8, including a liquids discharge outlet at the end of the bowl opposite to said solids discharge end and a second annular disc means which is stationary relative to said bowl and said conveyor, the outer periphery of said second disc lying radially outwardly of the radially innermost lip of a liquids chamber carried by the main bowl to receive liquids flowing out of said liquids discharge outlet.

11. A decanting centrifuge according to claim 1, including impeller means adapted to rotate with the bowl to draw gas from said gas volume through said passage means.

12. A decanting centrifuge according to claim 1, including impeller means adapted to rotate with the conveyor to draw gas from said gas volume through said passage means.

13. A decanting type centrifuge having a main bowl which is adapted to be rotated about its longitudinal axis and which contains a helical scroll conveyor which is arranged to rotate about said main bowl axis on a cylindrical conveyor hub at a slightly different speed to the main bowl for scrolling separated solids to a solids discharge end of the bowl, and first and second disc means attached to the conveyor hub for coaxial rotation therewith and disposed adjacent opposite ends of the bowl, respectively, the outer peripheries of said first and second disc means being arranged to lie radially outwardly of the inner liquid surface within the bowl so as to isolate a gas volume within said bowl, and passage means enabling gas to be extracted continuously from said gas volume to a location external to the main bowl.

* * * * *